US007621299B2

(12) United States Patent
Rouanet et al.

(10) Patent No.: US 7,621,299 B2
(45) Date of Patent: Nov. 24, 2009

(54) METHOD AND APPARATUS FOR FILLING A VESSEL WITH PARTICULATE MATTER

(75) Inventors: Stephane F. Rouanet, Westford, MA (US); James N. Litrun, Pepperell, MA (US); Will G. Durant, Long Beach, CA (US); Robert L. Beery, Atwood, IL (US)

(73) Assignee: Cabot Corporation, Boston, MA (US)

( * ) Notice: Subject to any disclaimer, the term of this patent is extended or adjusted under 35 U.S.C. 154(b) by 0 days.

(21) Appl. No.: 10/679,235

(22) Filed: Oct. 3, 2003

(65) Prior Publication Data

US 2005/0072488 A1 Apr. 7, 2005

(51) Int. Cl.
*B65B 1/20* (2006.01)

(52) U.S. Cl. ..... 141/12; 141/10; 141/74

(58) Field of Classification Search ..... 141/10–12, 141/71–78, 81, 114, 165, 166, 313, 316, 141/317

See application file for complete search history.

(56) References Cited

U.S. PATENT DOCUMENTS

| | | | |
|---|---|---|---|
| 2,595,262 | A | 5/1952 | Hood |
| 3,581,951 | A | 6/1971 | Sutter et al. |
| 3,741,857 | A | 6/1973 | Kakutani et al. |
| 3,768,227 | A | 10/1973 | Grisell |
| 3,953,110 | A | 4/1976 | Charoudi |
| 4,114,597 | A | 9/1978 | Erb |
| 4,443,987 | A | 4/1984 | Erb |
| 4,569,872 | A | 2/1986 | Miller |
| 4,667,417 | A | 5/1987 | Graser et al. |
| 4,954,327 | A | 9/1990 | Blount ..... 423/338 |
| 5,027,574 | A | 7/1991 | Phillip |
| 5,092,101 | A | 3/1992 | Kunert |
| 5,098,790 | A | 3/1992 | Diemunsch et al. |
| 5,154,953 | A | 10/1992 | de Moncuit et al. |
| 5,156,895 | A | 10/1992 | Martin |

(Continued)

FOREIGN PATENT DOCUMENTS

| | | | |
|---|---|---|---|
| DE | 886 180 | C | 8/1953 |
| DE | 922 515 | C | 1/1955 |
| DE | 25 14 316 | A1 | 10/1976 |
| DE | 3533805 | A1 | 3/1987 |
| DE | 3927538 | A1 | 2/1991 |

(Continued)

OTHER PUBLICATIONS

Acoustic Properties of Microporous SiO2-Aerogel, M. Gronauer and J. Fricke, Acustica, vol. 59, (1986), 177-181.

(Continued)

*Primary Examiner*—Timothy L Maust
*Assistant Examiner*—Nicholas A Arnett

(57) ABSTRACT

A method and an apparatus for filling a vessel having an internal volume with particulate matter are disclosed. The method generally comprises the steps of providing a vessel having a length, width, and an internal volume, providing a supply of particulate matter, filling at least a portion of the internal volume of the vessel with the particulate matter, and repeating the aforementioned steps until the internal volume of the vessel has been filled with the desired amount of particulate matter. While the vessel is being filled with the particulate matter, the vessel also is subjected to a vibratory motion or at least one tamping motion, or the static electricity produced upon filling the vessel with the particulate matter is discharged. The apparatus generally comprises a carrier assembly, a container, and at least one of an actuating assembly, a vibrator assembly, and a static discharge assembly.

13 Claims, 9 Drawing Sheets

U.S. PATENT DOCUMENTS

| | | | | |
|---|---|---|---|---|
| 5,291,705 | A | 3/1994 | Dickerson | |
| 5,294,472 | A | 3/1994 | Arnold et al. | |
| 5,294,480 | A | 3/1994 | Mielke et al. | |
| 5,381,149 | A | 1/1995 | Dougherty et al. | 342/1 |
| 5,394,786 | A | 3/1995 | Gettle et al. | 86/50 |
| 5,437,902 | A | 8/1995 | Itoh et al. | |
| 5,524,381 | A | 6/1996 | Chahroudi | |
| 5,550,338 | A | 8/1996 | Hielscher | 181/290 |
| 5,655,538 | A | 8/1997 | Lorraine et al. | 128/662.03 |
| 5,656,195 | A | 8/1997 | Mielke et al. | 252/62 |
| 5,748,758 | A | 5/1998 | Menasco, Jr. et al. | 381/176 |
| 5,786,059 | A | 7/1998 | Frank et al. | 442/68 |
| 5,789,075 | A | 8/1998 | Frank et al. | |
| 5,923,819 | A | 7/1999 | Ross et al. | |
| 5,948,314 | A | 9/1999 | Geiss et al. | |
| 5,968,618 | A | 10/1999 | Miller | |
| 6,012,449 | A | 1/2000 | Schulz | |
| 6,079,461 | A * | 6/2000 | Fisher et al. | 141/231 |
| 6,088,978 | A | 7/2000 | Satterwhite | |
| 6,110,561 | A | 8/2000 | Benz et al. | |
| 6,182,712 | B1 | 2/2001 | Stout et al. | |
| 6,250,792 | B1 * | 6/2001 | Krush et al. | 366/128 |
| 6,316,092 | B1 | 11/2001 | Frank et al. | |
| 6,370,838 | B1 | 4/2002 | Evason et al. | |
| 6,598,283 | B2 | 7/2003 | Rouanet et al. | |
| 6,598,358 | B1 | 7/2003 | Schwertfeger et al. | |
| 6,677,034 | B1 | 1/2004 | Hooley et al. | 428/323 |
| 6,708,734 | B2 * | 3/2004 | Rinehart | 141/12 |
| 6,709,600 | B2 | 3/2004 | Hrubesh et al. | |
| 6,887,563 | B2 | 5/2005 | Frank et al. | |
| 2001/0034375 | A1 | 10/2001 | Schwertfeger et al. | |
| 2004/0003866 | A1 * | 1/2004 | Rocchio et al. | 141/73 |
| 2004/0025876 | A1 | 2/2004 | Miller et al. | |
| 2004/0134560 | A1 * | 7/2004 | Sato et al. | 141/5 |
| 2004/0180176 | A1 * | 9/2004 | Rusek, Jr. | 428/69 |
| 2005/0046086 | A1 | 3/2005 | Lee et al. | |
| 2005/0048231 | A1 | 3/2005 | Morphet | |
| 2005/0072488 | A1 | 4/2005 | Rouanet et al. | |
| 2005/0074566 | A1 | 4/2005 | Rouanet et al. | |
| 2005/0167891 | A1 | 8/2005 | Lee et al. | |
| 2005/0263206 | A1 | 12/2005 | Parks et al. | |
| 2006/0272727 | A1 | 12/2006 | Dinon et al. | |
| 2007/0243358 | A1 * | 10/2007 | Gandini | 428/119 |

FOREIGN PATENT DOCUMENTS

| | | | |
|---|---|---|---|
| DE | 4319763 | A1 | 12/1994 |
| DE | 19507732 | A1 | 9/1996 |
| DE | 19634109 | A1 | 2/1998 |
| DE | 198 01 004 | A1 | 7/1999 |
| DE | 29917402 | U1 | 5/2000 |
| EP | 0018955 | A1 | 11/1980 |
| EP | 0171722 | A2 | 2/1986 |
| EP | 0340707 | A2 | 11/1989 |
| EP | 0468124 | A1 | 1/1992 |
| EP | 0 563 480 | A1 | 10/1993 |
| EP | 0 742 324 | A1 | 11/1996 |
| EP | 0839253 | A1 | 5/1998 |
| GB | 541 748 | A | 12/1941 |
| GB | 773083 | | 4/1957 |
| GB | 1098681 | | 1/1968 |
| GB | 2 061 354 | A | 5/1981 |
| GB | 2241468 | A | 9/1991 |
| GB | 2247040 | A | 2/1992 |
| GB | 2406353 | A | 3/2005 |
| JP | 8-268534 | A | 10/1996 |
| JP | 08268534 | A * | 10/1996 |
| RU | 2007407 | C1 | 2/1994 |
| RU | 2123434 | C1 | 12/1998 |
| RU | 2171820 | C1 | 8/2001 |
| RU | 2196536 | C2 | 1/2003 |
| RU | 2202474 | C2 | 4/2003 |
| RU | 2220460 | C2 | 12/2003 |
| SU | 194199 | | 5/1967 |
| SU | 351816 | | 9/1972 |
| SU | 381185 | | 5/1973 |
| SU | 668107 | | 6/1979 |
| SU | 735631 | | 5/1980 |
| SU | 742265 | | 6/1980 |
| SU | 747614 | | 7/1980 |
| SU | 929516 | | 5/1982 |
| SU | 1156963 | A | 5/1985 |
| SU | 1230944 | A1 | 5/1986 |
| SU | 1250509 | A1 | 8/1986 |
| SU | 1712247 | A1 | 2/1992 |
| SU | 1742124 | A1 | 6/1992 |
| WO | 98/07780 | A1 | 2/1998 |
| WO | WO 99/16419 | A1 | 4/1999 |
| WO | 99/36725 | A1 | 7/1999 |
| WO | 2005/033432 | A1 | 4/2005 |
| WO | 2007/047970 | A2 | 4/2007 |

OTHER PUBLICATIONS

Acoustic Properties and Potential Applications of Silica Aerogels, V. Gibiat et al. / Journal of Non-Crystaline Solids 186 (1995) 244-255.
Sound Propagation in $SiO_2$ Aerogels, J. Gross et al., J. Acoust. Soc. Am., vol. 91, No. 4, Pt. 1, Apr. 1992, 2004-2006.
A Theoretical Study of Sound Transmission Through Aerogel Glazing Systems, P.P. Narang, Applied Acoustics 34 (1991) 249-259.
Glazings with Granular Aerogel, Jorg J. Dengler and Volker Wittwer, Final Report Contract JOUE-CT90-0057, Dec. 15, 1993.
Glazings with Granular Aerogel, Jorg J. Dengler and Volker Wittwer, SPIE vol. 2255, 718-727.
"Glazings with Granular Aerogel", Jorg J. Dengler and Volker Wittwer, Final Report Contract JOUE-CT90-0057, Dec. 15, 1993.
International Search Report from International Application No. PCT/US2004/032647, filed on Oct. 1, 2004.
International Preliminary Report on Patentability from International Application No. PCT/US2004/032647, filed on Oct. 1, 2004.
English abstract of German Patent No. DE 19801004A1, published on Jul. 15, 1999.
European Search Report from EP 04 79 4119, filed on Oct. 1, 2004.
European Office Action, dated Aug. 6, 2008, from related European Patent Application No. 04 794 119.0-2308, filed Oct. 1, 2004.
Translation of Chinese Office Action of Jun. 2008, from corresponding Chinese Patent Application No. 200480034966.1.
Translation of Russian Office Action, dated Aug. 13, 2008, from corresponding Russian Patent Application No. 2006114827.
Partial English translation of Soviet Union Patent No. 351,816, published Sep. 28, 1972.
Partial English translation of Soviet Union Patent No. 742,265, published Jun. 25, 1980.
Partial English translation of Soviet Union Patent No. 747,614, published Jul. 15, 1980.
Partial English translation of Soviet Union Patent No. 1,712,247, published Feb. 15, 1992.
Partial English translation of Soviet Union Patent No. 1,742,124, published Jun. 23, 1992.
Ackerman et al., "Use of Surface Treated Aerogels Derived from Various Silica Precursors in Translucent Insulation Patenls," Journal of Non-Crystalline Solids, vol. 285 (2001), pp. 264-271.
Gütegemeinschaft Mehrscheiben-Isolierglas e.V., Rundschreiben Güte-Und Prüfbestimmungen, Troisdorf, Germany, Nov. 2002.
English translation of German Patent No. DE 39 27 538 A1, published Feb. 28, 1991.
English translation of International Publication No. WO 98/07780, published Feb. 26, 1998.
English translation of European Patent No. EP 0 839 253 B1, published Dec. 16, 1998.
English translation of German Utility Model Registration No. DE 299 17 402 U1, published May 4, 2000.

* cited by examiner

METHOD AND APPARATUS FOR FILLING A VESSEL WITH PARTICULATE MATTER

FIELD OF THE INVENTION

This invention pertains to a method for filling the internal volume of a vessel with particulate matter and an apparatus for accomplishing the same.

BACKGROUND OF THE INVENTION

Particulate material has been utilized in various vessels. For instance, several attempts have been made to decrease the thermal conductivity of a vessel (e.g., a window, skylight, etc.) by filling the internal volume of the vessel with a particulate material. Particulate material presents unique handling challenges, however, particularly with regard to filling the internal volume of a vessel. For example, due to several factors, such as the humidity of the container in which the particulate material is stored, particulate materials stored in bulk often have a tendency to agglomerate into relatively large agglomerates, which can make the handling of the particulate material much more difficult. These agglomerates can then impede the flow of the particulate material through the equipment used to handle the particulate material and into the internal volume of the vessel. Indeed, the process of filling the internal volume of a vessel becomes even more complicated when the dimensions of the agglomerates formed by the particulate material are larger than the opening in the vessel through which the internal volume is to be filled. Thus, known methods and apparatus for filling the internal volume of a vessel with a particulate material often are deleteriously affected by the agglomeration of the particulate material. Attempts to meet the unique problems encountered in handling large amounts of particulate material have met with varying success.

Furthermore, the handling of large amounts of particulate material often generates relatively large amounts of static electricity and causes the individual particles to become electrostatically charged. Apart from the hazards posed to equipment from such large amounts of static electricity, the electrostatic charge of the individual particles can cause the particles to agglomerate even further. Moreover, the electrostatic charge of the individual particles can cause the particles to adhere to the surfaces of the machines used to handle the particulate material, or it can cause the individual particles to adhere to the interior surfaces of the vessel, thereby impeding movement of the particulate material into the internal volume of the vessel. Despite the negative effects of such static electricity, none of the known methods and apparatus for filling the internal volume of a vessel has effectively addressed the problem of static electricity production during the filling of such vessels.

As known to those of skill in the art, a particulate material has a tendency to settle at a certain density (or a relatively narrow range of densities) when the particulate material is simply poured into a volume, such as the internal volume of a vessel. This density of the particulate material within the vessel that results from a simple pour into the vessel is generally referred to as the pour density. It is often desirable, however, to fill the internal volume of a vessel with a particulate material at a density that is higher than this pour density. For instance, filling the internal volume of a vessel with a particulate material at a relatively high density (e.g., a density higher than the pour density of the particulate material) can often dramatically improve (e.g., decrease) the thermal conductivity of the vessel as compared to a vessel that has been filled with the same particulate material at its pour density. While known methods and apparatus for filling the internal volume of a vessel can be used to fill the internal volume of a vessel with a particulate material at a density that is approximately equal to its pour density, these processes and apparatus cannot effectively be used to fill a vessel with a particulate material at a density that is substantially higher than the pour density of the particulate material.

Accordingly, a need exists for a method and apparatus for filling the internal volume of a vessel with a particulate material which addresses the foregoing and other problems not addressed by prior methods and apparatus. The invention provides such a method and apparatus. These and other advantages of the invention, as well as additional inventive features, will be apparent from the description of the invention provided herein.

BRIEF SUMMARY OF THE INVENTION

The invention provides a method for filling a vessel having an internal volume with particulate matter. The method generally comprises the steps of providing a vessel having a length, width, and an internal volume, providing a supply of particulate matter, filling at least a portion of the internal volume of the vessel with the particulate matter, and repeating the aforementioned steps until the internal volume of the vessel has been filled with the desired amount of particulate matter. While the vessel is being filled with the particulate matter, the vessel also is subjected to a vibratory motion or at least one tamping motion, or the static electricity produced upon filling the vessel with the particulate matter is discharged. The method of the invention can comprise any suitable combination of the aforementioned steps.

The invention also provides an apparatus for filling a vessel having an internal volume with particulate matter. The apparatus generally comprises a carrier assembly, a container, and at least one of an actuating assembly, a vibrator assembly, and a static discharge assembly. The carrier assembly has a length and a width and typically is provided at an angle greater than zero degrees and less than or equal to ninety degrees relative to horizontal. The carrier assembly is further adapted to carry and retain the vessel. The container comprises at least one opening and is adapted to contain the particulate matter. The container is further positioned above the vessel so that the particles flow through the opening and into the internal volume of the vessel.

When present, the actuating assembly is positioned to contact a portion of the carrier assembly and is adapted to reciprocally move the carrier assembly. The vibrator assembly, when present, is positioned to contact at least one of a portion of the carrier assembly or the surface of the vessel to impart a vibratory motion to the vessel when the vessel is disposed on the carrier assembly. The static discharge assembly can comprise a plurality of metallic protrusions (e.g., pins) and is positioned a distance from the vessel, the distance being of a size sufficient to allow static electricity produced upon filling the vessel to discharge from the vessel to the static discharge assembly. An apparatus according to the teachings of the invention can comprise any suitable combination of the aforementioned assemblies.

DETAILED DESCRIPTION OF THE INVENTION

Figure 1:
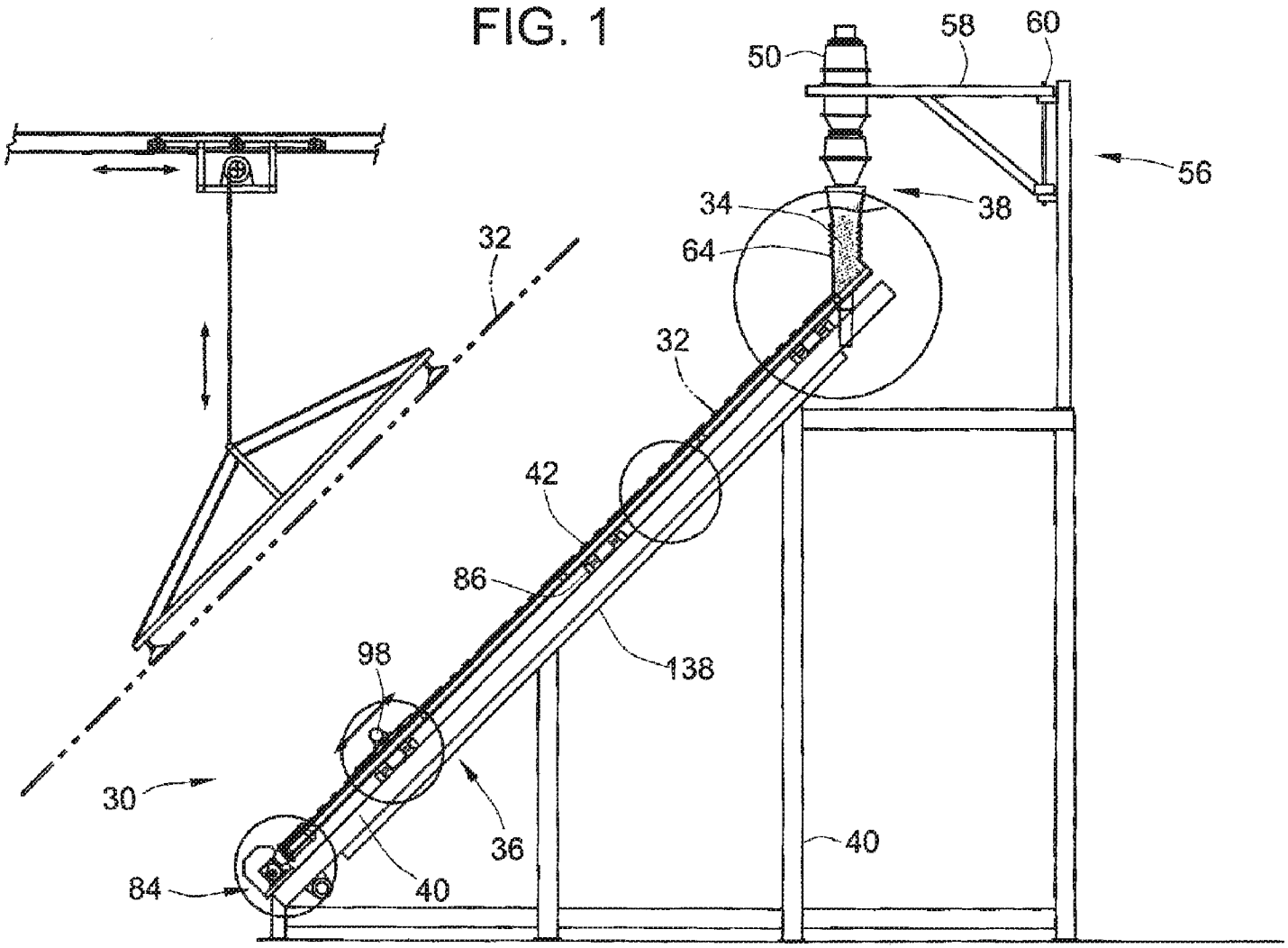
FIG. 1 is a side elevational view of an apparatus for filling the internal volume of a vessel with a particulate material constructed according teachings of the invention.
Figure 7:
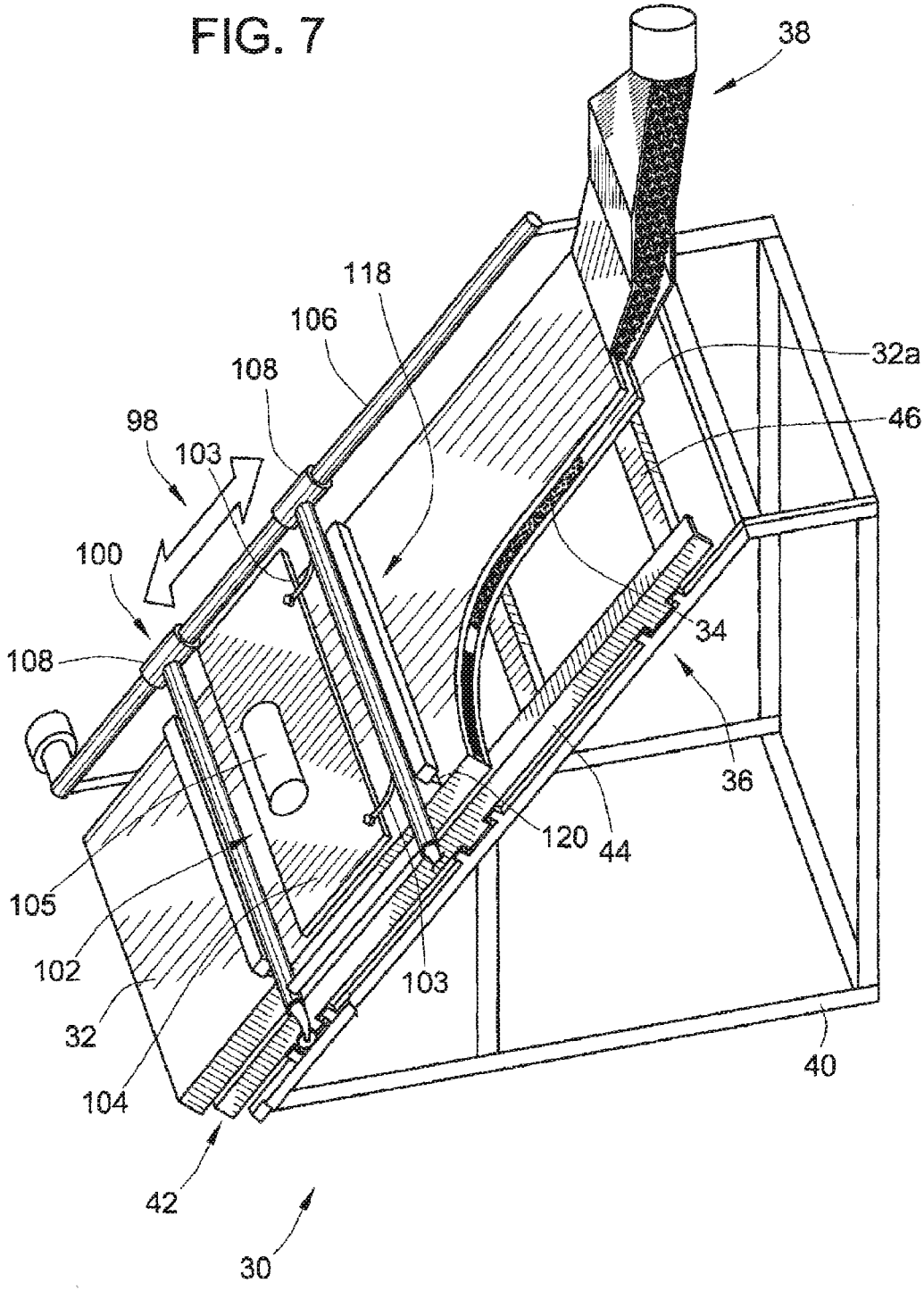
FIG. 7 is a perspective view of a vessel and an apparatus for filling the internal volume of a vessel with a particulate material constructed according teachings of the invention.

Turning now to the drawings, there is shown in FIG. 1 an apparatus 30 for filling the internal volume of a vessel 32 (illustrated in phantom) with particulate matter 34 constructed in accordance with teachings of the invention. The vessel 32 may be of any geometry but typically includes at least one opening 32*a*. The apparatus 30 comprises a support assembly 36 for supporting the vessel 32, and a fill assembly 38 for delivering the particulate material 34 to the opening 32*a* of the supported vessel 32. The support assembly 36 may be of any suitable construction. As depicted in FIG. 1, a frame 40 typically supports a carrier assembly 42, which is adapted to receive and support the vessel 32. The carrier assembly 42 has a length and a width, and is adapted to carry and retain the vessel 32. The carrier assembly 42 can comprise any suitable construction capable of carrying and retaining the vessel 32 and may be constructed of any suitable material. As illustrated in FIG. 7, the carrier assembly 42 comprises a generally rectangular framework with elongated side angle irons 44 and a plurality of crossmembers 46 spanning the width of the carrier assembly 42. It will be appreciated that this design provides a relatively lightweight, yet strong and stable support structure. The carrier assembly 42 may be constructed of, for example, steel. In order to further reduce the weight of the carrier assembly 42, however, the carrier assembly 42 more preferably is constructed of aluminum.

Figure 2:
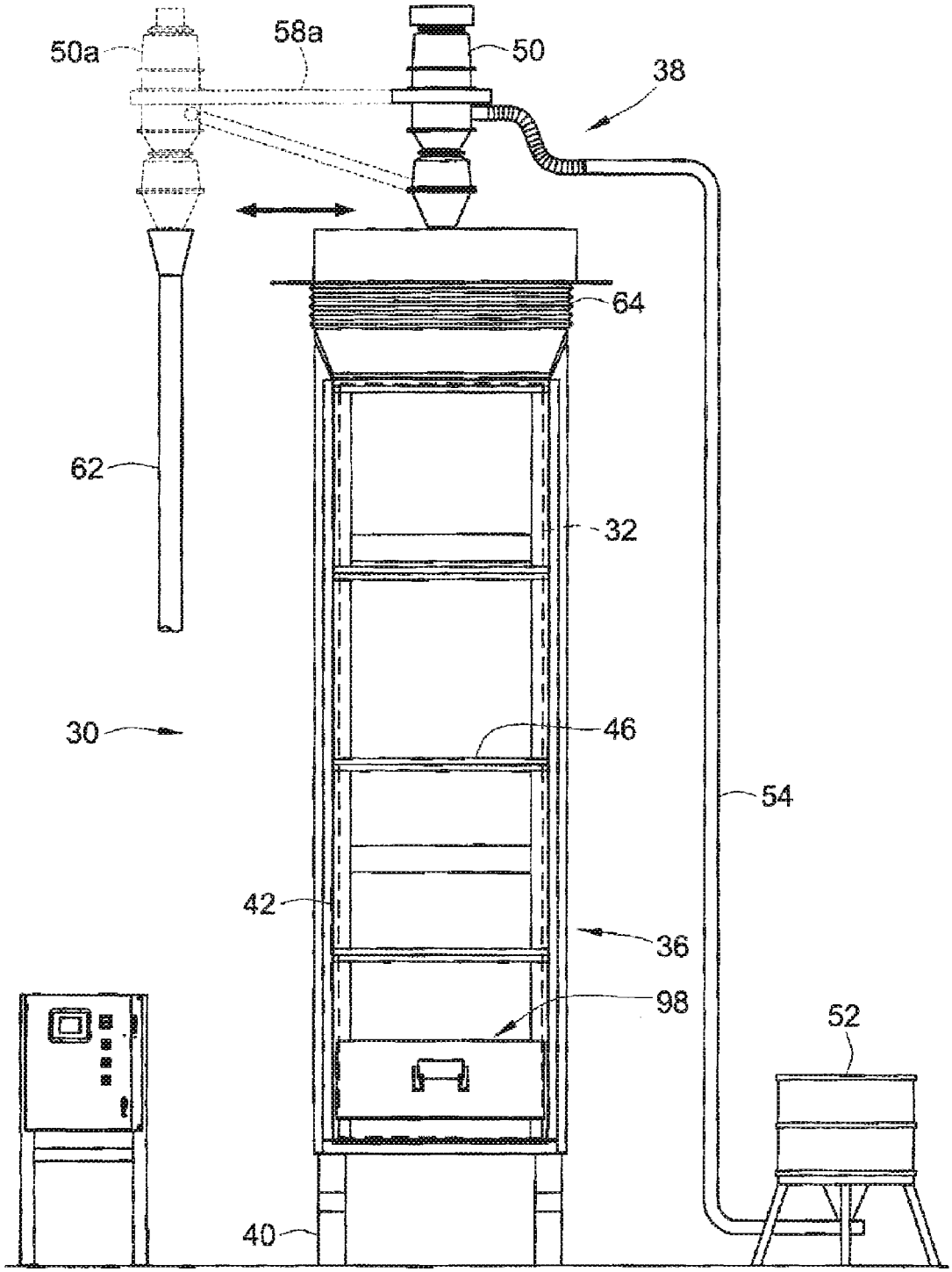
FIG. 2 is a front elevational view of the apparatus depicted in FIG. 1.

Returning to FIG. 1, the fill assembly 38 comprises a vacuum conveyor 50, which is disposed generally above a vessel 32 disposed on the carrier assembly 42. A flow of particulate matter 34 is provided into the vacuum conveyor 50 from a product supply. As depicted in FIG. 2, the product supply is in the form of a product supply hopper 52, which is coupled to the vacuum conveyor 50 by a vacuum hose 54 or the like. Although the vacuum conveyor 50 may be otherwise mounted in a stationary or movable configuration, the illustrated vacuum conveyor 50 is supported by a swivel support system 56, as illustrated in FIG. 1. An arm 58, which supports the vacuum conveyor 50, is pivotably coupled to the frame 40 at pivot point 60 such that the vacuum conveyor 50 may be swiveled to the side to align the vacuum conveyor 50 with a filter purge collection pipe 62 coupled to a dust collection system or the like.

Figure 6:
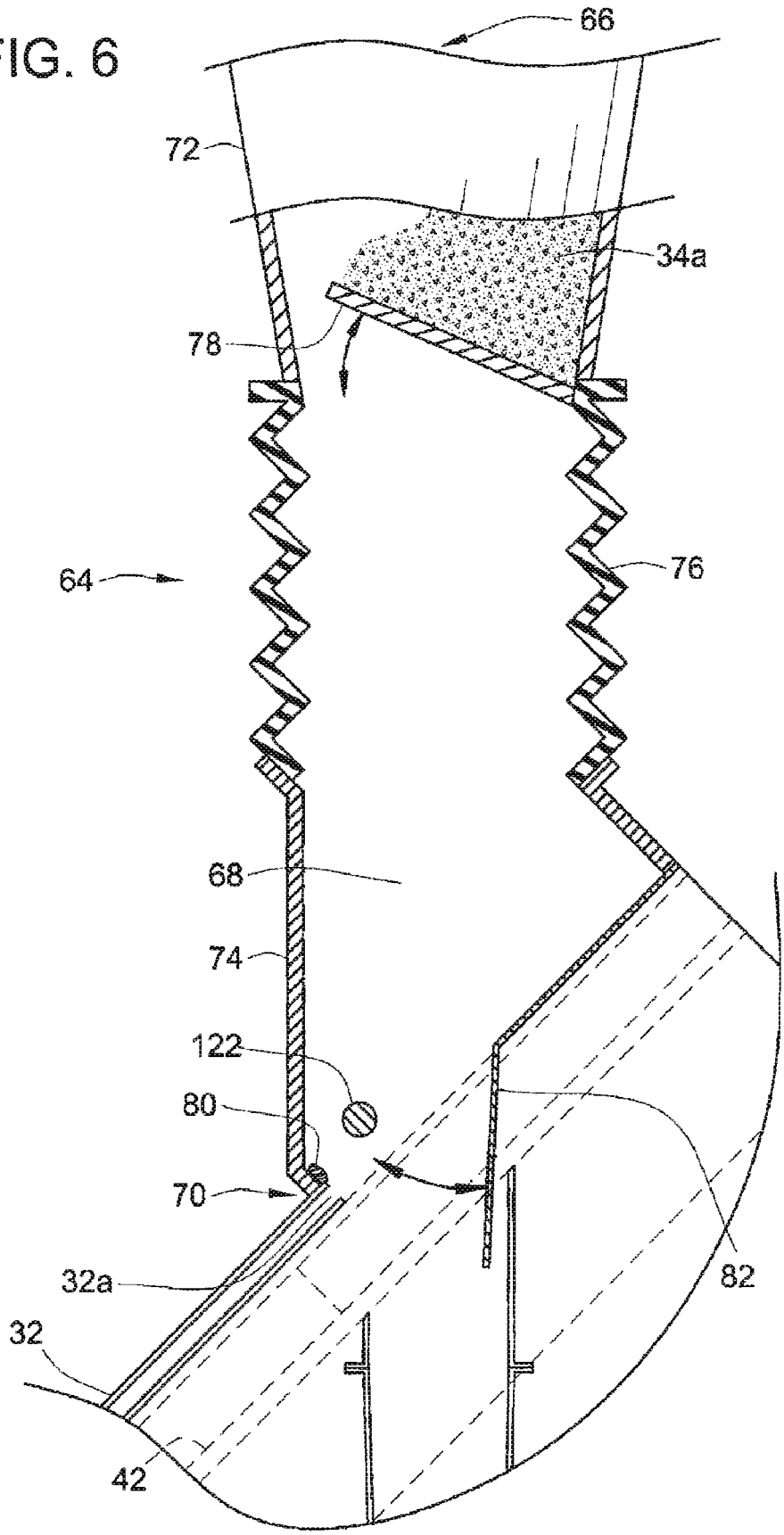
FIG. 6 is an enlarged, fragmentary sectional view of a preferred embodiment of the container of an apparatus constructed according to teachings of the invention.

In order to accurately direct the particulate matter 34 from the vacuum conveyor 50 to the vessel 32 supported on the carrier assembly 42, fill assembly 38 of the apparatus 30 further comprises a container 64 that acts as a conduit between the fill assembly 38 and the open end 32*a* of the vessel 32. As depicted in FIG. 6, which is an enlarged, more detailed view of a currently preferred container 64, the container 64 comprises at least one opening 66 for receiving particulate matter 34 from the vacuum conveyor 50 into an internal cavity 68, and at least one opening 70 for fluid connection with the vessel opening 32*a*. The container 64 is generally positioned above the vessel 32 so that the particulate matter 34*a* flows through the opening 70 and into the internal volume of the vessel 32.

The container 64 depicted in FIG. 6 also comprises an upper hopper 72 and a lower hopper 74, which are movably coupled to each other by a bellows 76. To facilitate movement of the particulate matter 34 through the container 64, a vibrator assembly may be positioned adjacent to any portion of the container 64. This vibratory motion serves to fluidize any particulate matter that collects within the container 64, thereby allowing the particulate matter 34 to flow into the next portion of the container 64 or from the container 64 into the vessel 32. It will be appreciated that the moveable bellows 76 allows relative movement between the upper and lower hoppers 72, 74, enhancing this forward movement of the particulate matter 34. The upper and lower hoppers 72, 74 can be constructed of any suitable material. Preferably, the upper and lower hoppers 72, 74 are constructed of steel or aluminum. The bellows 76 can be constructed of any suitable flexible material, but are preferably constructed of a natural or synthetic rubber.

In order to control the direction and the amount of particulate matter 34*a* flowing to the lower hopper 74, the upper hopper 72 can comprise at least one gate 78 positioned at the lower portion of the upper hopper 72 and above the bellows 76. Preferably, the upper hopper comprises a plurality of (e.g., at least 3) gates 78, which gates 78 are disposed along the width of the upper hopper 72 and are adapted to restrict or prevent the flow of the particulate matter 34*a* into the respective underlying portions of the bellows 76 and the lower hopper 74.

The lower hopper 74 preferably is coupled to the carrier assembly 42, which is shown in phantom in FIG. 6. In this way, the distal end of the vessel 32 presenting the opening 32*a* is received in the opening 70 of the lower hopper 74, providing a fluid connection therebetween for the flow of particulate matter 34*a*.

In order to ensure that the particulate matter 34*a* flows into the vessel 32, the lower hopper 74 preferably further comprises a sealing element 80 adapted to provide a seal between the lower hopper 74 and the portion of the vessel 32 projecting through the opening 70. The sealing element 80 can comprise any suitable structure and material. Preferably, the sealing element 80 is of a dynamic structure that may adapt to and seal against various sizes of vessels 32 and/or openings 32*a*. The currently preferred embodiment illustrated comprises an air bladder that is positioned above the opening 70 in the lower hopper 74 and is attached to the inner surface of the lower hopper 74. After a portion of the vessel 32 has been inserted into the opening 70 of the lower hopper 74, the air bladder is then inflated until it expands and blocks any portion of the opening 70 that is not obstructed by the vessel 32. In this way, the sealing element 80 directs the flow of particulate matter 34*a* from the internal cavity 68 of the container 64 through the opening 32*a* of the vessel 32.

In order to ensure that the flow of particulate matter 34*a* into the internal volume of the vessel 32 is uninterrupted while the internal volume of the vessel 32 is being filled, the container 64 typically is filled with an excess of particulate matter 34*a* (e.g., the amount of particulate matter contained in the container 64 is preferably about 10 to about 20 percent greater than the amount necessary to completely fill the internal volume of the vessel 32). While the internal volume of the vessel 32 can still be filled if the flow of particles into the vessel 32 is interrupted, it has been found that such interruptions result in an uneven distribution of the individual particles 34*a* within the vessel 32. More specifically, it has been found that when the flow of particulate material into the internal volume of the vessel 32 is interrupted, the internal volume of the vessel 32 can be filled with regions in which the average size of the individual particles is significantly less than the surrounding regions. Such regions of differing particle sizes can, for example, produce undesirable optical properties in a translucent or transparent vessel 32.

Returning to FIG. 6, due to the excess amount of particulate matter 34*a*, the container 64 typically contains a sizable amount of particulate matter 34*a* after the internal volume of the vessel 32 has been completely filled. In order to discharge this excess of particulate matter from the container 64, the container 64 preferably comprises a purge gate 82 positioned at the bottom of the container 64 and adapted to allow the excess particulate matter 34*a* to flow out of the container 64. As depicted in FIG. 6, the purge gate 82 is located in the lower hopper 74. The purge gate 82 can be opened and closed by any suitable means. Typically, the purge gate 82 is opened and closed using at least one pneumatic or hydraulic cylinder, which cylinder is attached to the outside of the container 64 and is movably coupled to the purge gate 82. The purge gate 82 can release the particulate matter 34*a* into any suitable purge system, which can be used to collect the excess particulate matter for recycling, disposal, etc.

In accordance with teachings of the invention, the apparatus 30 provides various structure and the invention provides various methods of filling to provide the desired filling characteristics and increased density of particulate matter 34 within the vessel 32. In this regard, the vessel 34 is subjected to one or more of various forces which facilitate flow of the particulate matter 34 into and through the vessel 32.

In order to facilitate the flow of the particulate matter through the internal volume of the vessel, the carrier assembly 42 is provided at an angle that is equal to or greater than the angle of repose of the particulate matter 34 to ensure that the particulate matter 34 will feed under the force of gravity (i.e., greater than zero degrees and less than or equal to 90 degrees relative to horizontal). The carrier assembly 42 may be provided at any suitable angle such as, for example, about 10 to about 90 degrees relative to horizontal, about 20 to about 90 degrees relative to horizontal, about 30 to about 90 degrees relative to horizontal, or about 40 to about 80 degrees relative to horizontal. For example, for filling with an aerogel particulate matter, the angle of the carrier assembly 42 is preferably greater or equal to about 37 degrees, the angle of repose of such material. In the currently preferred embodiment the angle of the carrier assembly 42 for a vessel 32 to receive aerogel particulate matter, the angle of the carrier assembly 42 is on the order of 45 degrees from horizontal. In this regard, when carrier assembly 42 is supported on a frame 40, as shown, the frame 40 may provide structure for varying the angle of the vessel 32 supported on the carrier assembly 42.

Further, the vessel 32 can be subjected to various forces and motions which facilitate the flow of the particulate matter 34 into and through the vessel 32. More specifically, the vessel 34 is preferably subjected to one or, preferably, both of a vibratory motion and/or a tamping motion.

As utililzed herein, the term "tamping motion" refers to a very low frequency, high amplitude jarring motion applied to the vessel 32. The tamping motion, when present, serves to pack the particulate matter 34 into the internal volume of the vessel 32 at a density greater than the pour density of the particulate matter 34 (e.g., the density that results from simple pouring of the particulate matter 34). The tamping motion can be generated in any suitable manner, but preferably by a mechanical actuator 84, which provides a reliable, repetitive motion. Typically, the tamping motion is generated by impacting a portion of the vessel 32, or a frame or carrier on which the vessel 32 rests, on a static surface. It will be understood that the tamping motion generates a deceleration in a direction that tends to pack the particulate matter 34 into the internal volume of the vessel 32 (e.g., when the vessel 32 is inclined, the deceleration is directed to pack the particulate matter 34 into the lower portion of the vessel 32). The tamping motion can generate a deceleration that is directed in a substantially horizontal direction, substantially vertical direction, or a combination thereof. Preferably, the vessel 32 is inclined while it is being filled with particulate matter, and the tamping motion (e.g., the deceleration) is directed along an axial direction of the vessel 32. In order to maximize the packing of the particulate matter, the tamping motion preferably subjects the vessel 32 to at least one deceleration of at least about 900 $m/s^2$.

In order to provide such a tamping motion in the illustrated embodiment, the vessel 32 is mounted for axial movement. Here, the carrier assembly 42 supporting the vessel 32 is movably coupled to the frame 40. Such movable attachment not only allows for the easy loading and unloading of the vessel 32, it further permits movement of the carrier assembly 42 relative to the frame 40 when a tamping force is exerted on the carrier assembly 42 by an actuating assembly 84.

Figure 3:
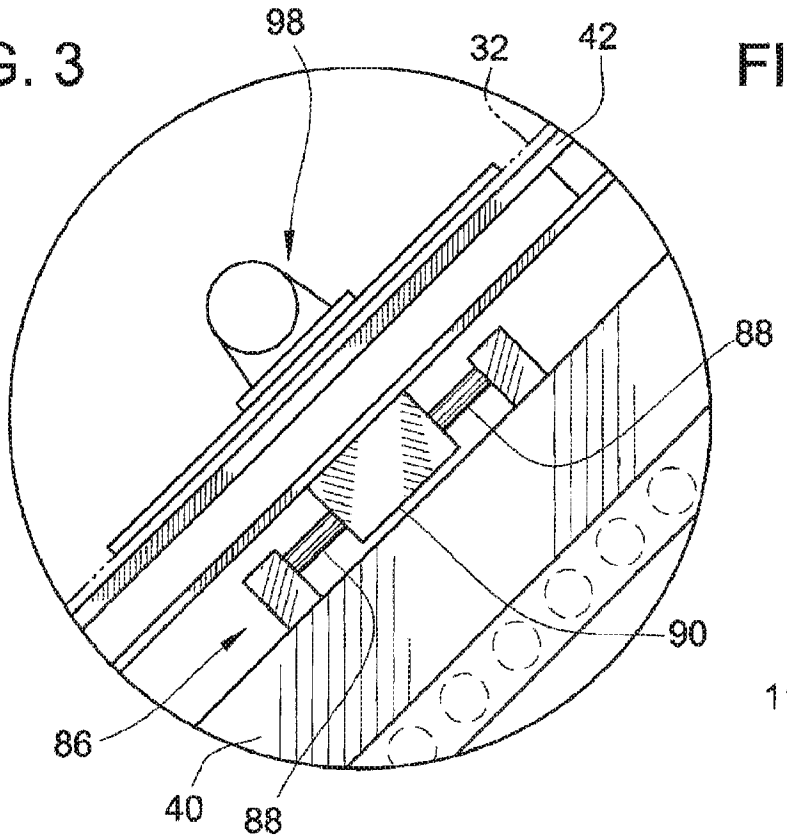
FIG. 3 is an enlarged side elevational view of the apparatus depicted in FIG. 1 showing the vibrator assembly, carrier assembly, and vessel.

It will be appreciated by those of skill in the art that the carrier assembly 42 can be movably attached to the frame 40 in any suitable manner. For instance, the carrier assembly can further comprise a plurality of (e.g., at least 4) rollers attached to the surface of the carrier assembly that confronts the frame. These rollers are positioned to contact and roll up or across a portion of the frame 40, thereby allowing for the movement of the carrier assembly 42 relative to the frame 40. Alternatively, the rollers can be attached to the frame 40 and positioned to contact and roll up or across a portion of the carrier assembly 42. Preferably, as depicted in FIG. 3, the carrier assembly 42 is movably attached to the frame 40 via a plurality of (e.g., at least 4) kinematic pairs 86. As utilized herein, the term "kinematic pair" refers to a pair of elements or links that are connected together in such a way that their relative motion in a particular direction is partly or completely restrained. The two elements of the kinematic pair can comprise a rod 88 and a sleeve 90, the relative movement of which is assisted by roller bearings (not visible) mounted within the sleeve 90. It will be understood that one of the elements of the kinematic pair 86 must be fixedly attached to the carrier assembly 42, and the other element must be fixedly attached to the frame 40.

As depicted in FIG. 1, the actuating assembly 84, when present, is positioned to contact a portion of the carrier assembly 42 and is adapted to reciprocally move the carrier assembly 42 supporting the vessel 32. The actuating assembly 84 can be adapted to reciprocally move the carrier assembly 42 in any suitable direction. In particular, the actuating assembly 84 can reciprocally move the carrier assembly 42 in a substantially horizontal direction, a substantially vertical direction, or a combination thereof. Preferably, the actuating assembly 84 is adapted to reciprocally move the carrier assembly 42 in a direction along the length of the vessel 32 to most effectively enhance movement of the particulate matter 34 through the length of the vessel 32.

Figure 5B:
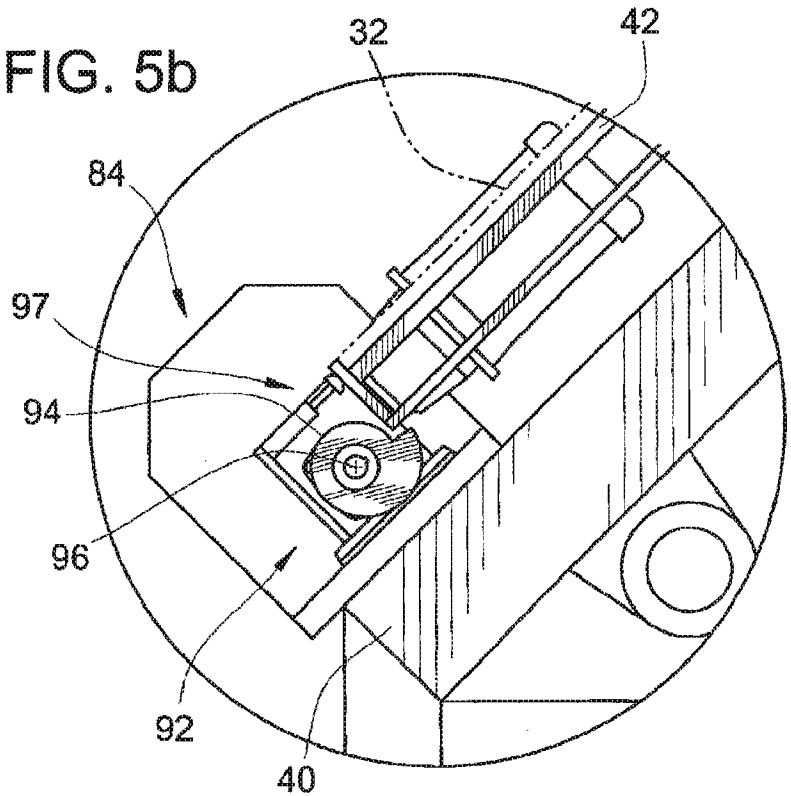
FIG. 5B is an enlarged side elevational showing the cam assembly and the carrier assembly in a different position than the position depicted in FIG. 5A.
Figure 5A:
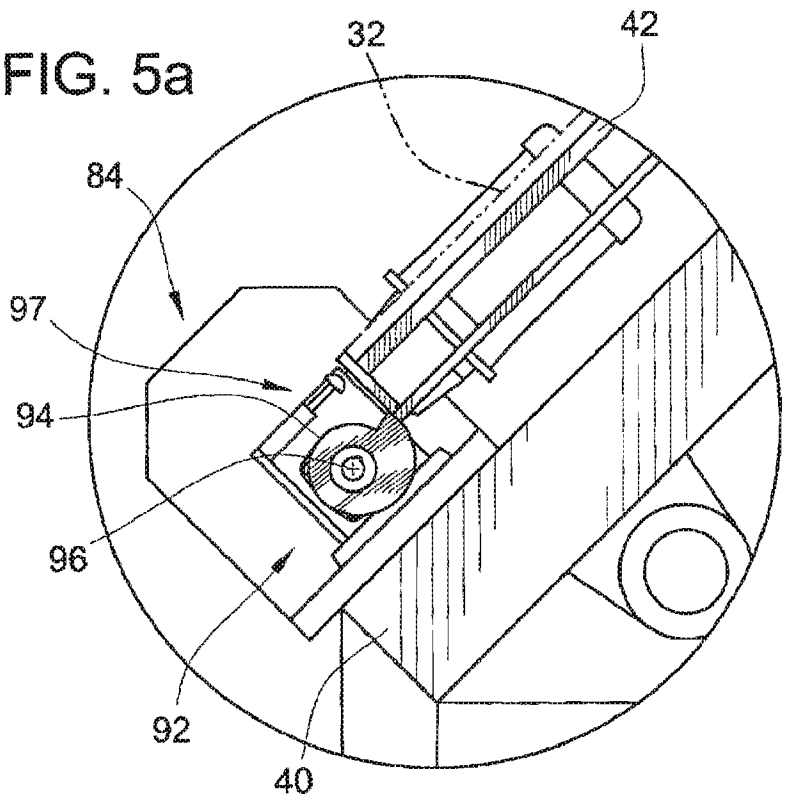
FIG. 5A is an enlarged side elevational view of the apparatus depicted in FIG. 1 showing the cam assembly, carrier assembly, and vessel.

The actuating assembly 84 can comprise any suitable device capable of reciprocally moving the vessel 32, here by moving the carrier assembly 42. For example, the actuating assembly 84 can comprise a pneumatic or hydraulic cylinder, which cylinder is coupled to the carrier assembly 42 and a stationary construction, such as the frame 40. Preferably, as depicted in FIG. 5A and FIG. 5B, the actuating assembly 84 comprises a cam assembly 92, more preferably a two-dimensional spiral cam assembly, the carrier assembly 42 or a structure associated with the carrier assembly 42 acting as the cam follower. As utilized herein, the term "spiral cam assembly" refers to a cam assembly in which the body of the cam is provided in a substantially spiral shape (i.e., the distance between the axis of rotation and the surface of the cam confronting the cam follower increases as the cam is rotated). The cam assembly preferably is positioned such that the peripheral surface of the rotating cam 94, when rotated through one complete revolution, contacts the lower portion of the carrier assembly 42 during at least a portion of that revolution. More specifically, as depicted in FIG. 5A and FIG. 5B, the cam assembly 92 typically is positioned to contact the lowest distal end portion of the carrier assembly 42, although the cam assembly 92 can contact the carrier assembly 42 at any suitable point. For example, when the cam assembly 92 is positioned to contact the lower end of the carrier assembly 42, as shown, the cam assembly 92 can contact the carrier assembly 42 at the approximate middle of the width of the carrier assembly 42, or near the edge of the cam assembly. Preferably, the cam assembly comprises at least two such cams 94, each of which is positioned to contact the carrier assembly 42 neat opposite edges of the carrier assembly 42.

When the actuating assembly 84 is operated, the two-dimensional spiral cams 94 are rotated, pushing the cam follower (e.g., the carrier assembly 42) an increasing distance away from the axis of rotation 96 of the cams 94. Once the spiral cam assembly 92 has completed one revolution, the cam follower (e.g., the carrier assembly 42) no longer contacts the peripheral surface of the spiral cam 94, and the cam follower (e.g., the carrier assembly 42) is allowed to abruptly fall until it contacts a stationary surface or object. Accordingly, by rotating the spiral cam assembly 92, the carrier assembly 42 is lifted along its length until it drops and impacts a stationary surface or object. This reciprocating lifting and dropping motion subjects the carrier assembly 42 to a low frequency tamping motion, the force and deceleration of which is directed along the length of the carrier assembly 42.

The cam follower (e.g., the carrier assembly 42) can be permitted to fall and contact any suitable stationary surface or object once it no longer contacts the peripheral surface of the spiral cam 94. For example, the cam follower (e.g., the carrier assembly 42) can abruptly fall to the surface of the cam 94 closest to the axis of rotation 96 of the spiral cam 94. Alternatively, as depicted in FIG. 5B, the cam follower (e.g., the carrier assembly 42) can abruptly fall until it contacts a bump stop assembly 97. The bump stop assembly 97 can comprise any suitable assembly capable of abruptly stopping the cam follower (e.g., the carrier assembly 42). For example, the bump stop assembly 97 can comprise a stop and a mount, the mount being fixedly attached to a stationary object, such as the frame of the apparatus or a stationary portion of the cam assembly (as depicted in FIG. 5A and FIG. 5B). In order to permit adjustment of the distance through which the cam follower (e.g., the carrier assembly 42) falls after it no longer contacts the peripheral surface of the cam 94, the position of the stop relative to the mount preferably is adjustable (e.g., the overall length of the bump stop assembly 97 can be adjustable). Adjustment of the stop relative to the mount can be provided in any suitable manner. For example, the bump stop assembly 97 can further comprise a threaded fastener (e.g., a threaded rod) which is attached to the stop and mates with a threaded receptacle (e.g., a nut or a threaded cavity) fixedly attached to or provided within the mount. Such an arrangement permits the longitudinal position of the stop relative to the mount to be adjusted by rotation of the threaded fastener.

The vessel 32 can alternately or additionally be subjected to a vibratory motion in any suitable manner. As utilized herein, the term "vibratory motion" is utilized to refer to a shock-free, sinusoidal motion as observed for a single point on the vessel 32. Typically, the vessel is subjected to a vibratory motion by contacting a portion of the vessel 32 or any surface upon which the vessel 32 is placed (e.g., the carrier assembly 42) with a vibrator assembly 98. The vibratory motion imparted to the vessel 32 can be localized (e.g., the most intense and effective vibratory motion can be localized in a portion of the vessel 32) or distributed over the entire vessel 32 (e.g., the intensity of the vibratory motion can be substantially the same over the entire vessel 32). When the vibratory motion is localized, the vibratory motion preferably is moved to localize the vibratory motion in a portion of the vessel 32 where the particles have agglomerated or adhered to the surface of the vessel 32. When the method comprises a combination of a vibratory motion and at least one tamping motion, the vibratory motion can be ceased before the vessel 32 is subjected to the at least one tamping motion. However, the vessel 32 preferably is simultaneously subjected to the vibratory motion and at least one tamping motion.

The vibratory motion may be provided by any appropriate vibrator assembly 98. As depicted in FIG. 3, the vibrator assembly 98 is positioned to contact at least one of a portion of the carrier assembly 42 or the surface of the vessel 32 to impart a vibratory motion to a vessel 32 disposed on the carrier assembly 42. In order to maximize the effectiveness of the vibratory motion imparted to the vessel 32, the vibrator assembly 98 preferably contacts the surface of the vessel 32.

The vibrator assembly can impart any suitable vibratory motion to a vessel 32 disposed on the carrier assembly 42. Preferably, the vibratory motion comprises a limited displacement (e.g., about 10 mm or less, about 5 mm or less, or about 2 mm or less) directed along two mutually perpendicular axes, at least one of which is substantially perpendicular to the surface of the vessel. The vibratory motion can have any suitable frequency. Preferably, the vibratory motion has a frequency of at least about 100 Hz, more preferably at least about 200 Hz, and most preferably at least about 250 Hz.

The vibrator assembly 98 can comprise any suitable apparatus capable of imparting a vibratory motion to the vessel 32. As depicted in FIG. 7, the vibrator assembly 98 comprises a transport assembly 100 and a vibrator panel 102. The vibrator panel 102 is suspended from the transport assembly 100 by any appropriate means, here, a pair of cables 103, and is positioned to contact a surface of the vessel 32. The vibrator panel 102 generally comprises a panel 104 and a vibrator 105. The panel 104 can be constructed of any suitable material, such as wood, plastic, or metal, and the vibrator 105 can be any suitable commercially available vibrator. In order to prevent damage to the surface of the vessel 32, the panel 104 preferably has a protective covering (e.g., cloth) attached to the surface of the panel 104 confronting the surface of the vessel 32.

In order to provide vibratory motion and, therefore, the most effective movement of the particulate matter 34 within and along the length of the vessel 32, the transport assembly 100 can be moved relative to the carrier assembly 42 and the vessel 32 using any suitable apparatus. For example, as depicted in FIG. 7, the transport assembly 100 can comprise a rod 106 and at least two sleeves 108 slidably coupled to the rod 106 and attached to the remainder of the transport assembly 100. The sliding movement of the sleeves 108 along the rod 106 can be assisted by roller bearings (not visible) mounted within the sleeves 108. It will be appreciated by those of skill in the art that the transport assembly can then be lifted and lowered along the rod 106. For example, a winch can be positioned at any suitable point on the apparatus, such as the base of the frame, a pulley can be positioned at the top of the apparatus, and a cable, which originates from the winch and passes through the pulley, can be attached to the transport assembly 100. Alternatively, the transport assembly can be attached to a gear belt that runs along the sides of the carrier assembly 42, and the drive and gears for the gear belt can be attached to the top and bottom of the frame 40.

As noted above, several factors can contribute to the agglomeration of the individual particles of a supply of particulate matter. For instance, static electricity typically is produced upon filling a vessel with certain types of particulate matter (e.g., electrostatically chargeable particles). While not wishing to be bound to any particular theory, it is believed that such static electricity is generated by the friction-induced loss or gain of electrons by the individual particles as the particles pass from the container into the internal volume of the vessel. As utilized herein, the term "electrostatically chargeable particles" refers to particulate matter whose particles can become electrostatically charged due to the friction generated by movement of the particles. This loss or gain of electrons then generates particles having dissimilar charges and/or particles having a charge that is dissimilar to the charge of the vessel or the container, which can cause the particles to agglomerate and/or adhere to the surfaces of the vessel or the container, thereby impeding the flow of the particles into the internal volume of the vessel. Thus, in order to facilitate flow of the particulate matter 34 into the internal volume of the vessel 32, the static electricity produced upon filling the vessel 32 with the particulate matter 34 is discharged prior to and/or during the filling process.

The static electricity produced upon filling the internal volume of the vessel 32 with the particulate matter 34 can be discharged using any suitable method. For instance, the static electricity produced upon filling the vessel 32 can be actively discharged by ionizing the atmosphere surrounding the vessel 32. While not wishing to be bound to any particular theory, it is believed that the ionization of the atmosphere at several points surrounding the vessel 32 produces ions that can interact with the surface of the vessel 32 and supply or assimilate the electrons needed to neutralize the static charge that builds up at the surface of the vessel 32 as it is being filled with the particulate matter 34.

Alternatively, the static electricity produced upon filling the internal volume of the vessel 32 with the particulate matter 34 can be discharged by placing a grounded conductor (i.e., a conductor that is connected to an electrical ground) near the surface of the vessel 32. By placing a grounded conductor near the surface of the vessel 32, the static charge at a point on the vessel 32 proximate to the grounded conductor increases until the charge is great enough to generate an electrical arc passing from the surface of the vessel 32 to the grounded conductor. The electrical charge necessary to produce such an electrical arc between the surface of the vessel 32 and the grounded conductor can depend upon several factors, such as the humidity of the surrounding environment, but the necessary charge typically is about 7800 V per centimeter of distance between the grounded conductor and the surface of the vessel 32.

In order to further impede the generation of static electricity upon filling the internal volume of the vessel 32 with particulate matter 34, the particulate matter 34 can be exposed to an amount of humidified air sufficient to reduce the amount of static electricity produced upon filling the internal volume of the vessel 32. It will be understood that the amount of humidified air required to reduce the amount of static electricity produced can depend upon several factors, such as the relative humidity of the ambient atmosphere and the relative humidity of the particulate matter 34 (e.g., the relative humidity of the environment in which the particulate matter 34 is contained or stored). The particulate matter 34 can be exposed to the humidified air in any suitable manner. Preferably, an amount of humidified air sufficient to reduce the amount of static electricity produced upon filling the internal volume of the vessel 32 with the particulate matter 34 is injected into the internal volume of the vessel 32 while the vessel 32 is being filled with the particulate matter 34. Alternatively (or additionally), an amount of humidified air sufficient to reduce the amount of static electricity produced upon filling the internal volume of the vessel 32 with the particulate matter 34 can be injected into the supply of particulate matter 34 before the vessel 32 is filled with the particulate matter 34 and/or while the vessel 32 is being filled with the particulate matter 34. The humidified air can have any suitable humidity. Preferably, the humidified air has a relative humidity of about 80% or more (e.g., about 85% or more, about 90% or more, about 95% or more, or about 100%). As utilized herein, the term "relative humidity" refers to the measure of the amount of water vapor actually present in the air as compared to the greatest amount possible at the same temperature.

An apparatus constructed according to the teachings of the invention can comprise a static discharge assembly. Generally, the static discharge assembly is positioned a distance from the vessel 32, the distance being of a size sufficient to allow static electricity produced upon filling the vessel 32 to discharge from the vessel 32 to the static discharge assembly. It will be understood that the aforementioned distance can depend upon several factors, such as the relative humidity of the environment in which the apparatus is housed, the particular type of static discharge assembly used, and many others. Typically, the static discharge assembly is positioned about 1 to about 3 centimeters from the surface of the vessel 32.

Figure 4:
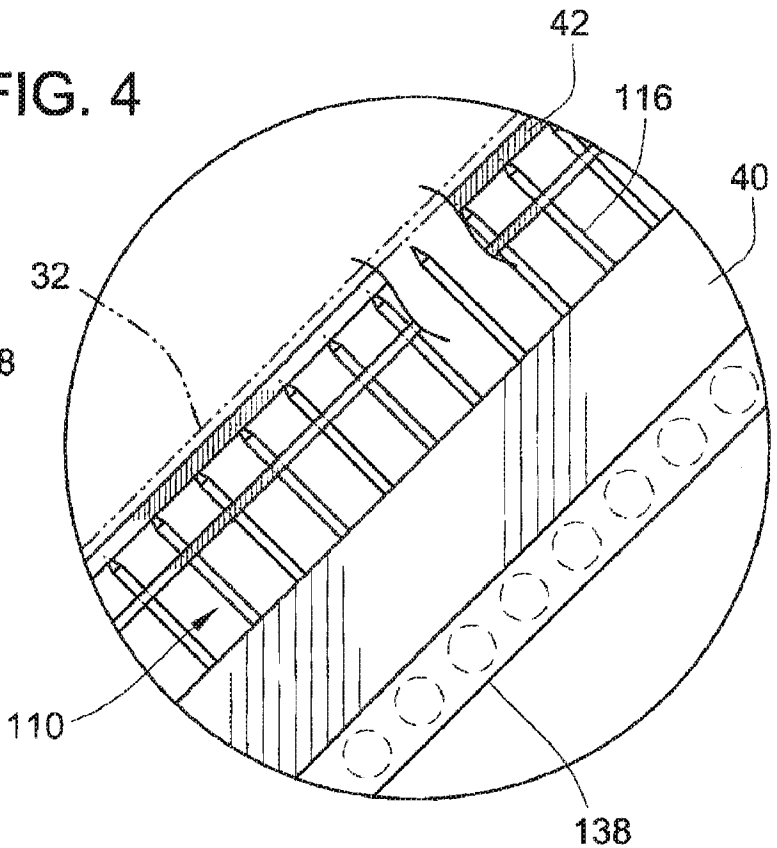
FIG. 4 is an enlarged side elevational view of the apparatus depicted in FIG. 1 showing the carrier assembly, static discharge assembly, and vessel.

The static discharge assembly can comprise any suitable apparatus capable of discharging the static electricity produced upon filling the internal volume of the vessel 32 with the particulate matter. For example, the static discharge assembly can comprise an apparatus capable of ionizing the atmosphere surrounding the vessel 32, such as a corona discharge ionization bar. Alternatively, the static discharge assembly can comprise a plurality of metallic protrusions disposed near the surface of the vessel 32, which metallic protrusions are connected to an electrical ground and are adapted to provide a path for the static electricity to discharge from the surface of the vessel 32. In order to provide for the localization of the static charge on the surface of the vessel 32 at as small a point as possible, which will increase the frequency of the discharges, the metallic protrusions preferably are provided in a substantially conical shape, the tip of which is placed about 1 to about 3 cm from the surface of the vessel 32. Such an embodiment of the static discharge assembly 110 is depicted in FIG. 4. In particular, the static discharge assembly 110 can comprise a plurality of metallic protrusions 116 positioned between the carrier assembly 42 and the frame 40 and disposed near the surface of the vessel 32 confronting the carrier assembly 42. In such an embodiment, the plurality of metallic protrusions 116 can be formed by attaching woven, metallic hardware cloth to the frame 40 and clipping portions of the weave to provide a network of metallic protrusions 116 disposed near the surface of the vessel 32. In another embodiment, the static discharge assembly 118 can be attached to the transport assembly 100 in order to provide a localized discharge of the static electricity produced upon filling the vessel 32. As depicted in FIG. 7, the static discharge assembly 118 can be attached to the leading and trailing edges of the transport assembly 100 of the vibrator assembly 98. In such an embodiment, the static discharge assembly 118 preferably comprises a plurality of metallic protrusions 120 (e.g., pins) projecting from the static discharge assembly 118 towards the surface of the vessel 32.

The generation of static electricity upon filling the vessel 32 can also be impeded by ionizing the atmosphere surrounding the point where the particulate matter 34 enters the internal volume of the vessel 32 (e.g., an opening in the vessel 32). While not wishing to be bound to any particular theory, it is believed that the ionization of the atmosphere at such a point produces ions that can interact with the individual particles of the particulate matter 34 and supply or assimilate the electrons needed to neutralize the static charge on the particles. The atmosphere surround a point where the particulate matter 34 enters the internal volume of vessel 32 can be ionized using any suitable method. Preferably, the atmosphere is ionized using a corona discharge, which can be produced using a corona discharge ionization bar. As utilized herein, the term "corona discharge" refers to a discharge at the surface of a conductor or between two conductors of the same transmission line, which is accompanied by ionization of the surrounding atmosphere.

In order to discharge at least a portion of the static electricity in the particulate matter 34*a* before it flows into the vessel 32, the container 64 can further comprise a further static discharge assembly 122. As depicted in FIG. 6, the further static discharge assembly 122 can be positioned within the lower hopper 74, and is preferably disposed proximate to (e.g., about 5 to about 20 mm away from, or about 5 to about 10 mm away from) the opening 70 in the lower hopper 74 and the vessel 32. The further static discharge assembly 122 can comprise any suitable apparatus for discharging static electricity. Preferably, the further static discharge assembly 122 comprises a corona discharge ionization bar.

Figure 8:
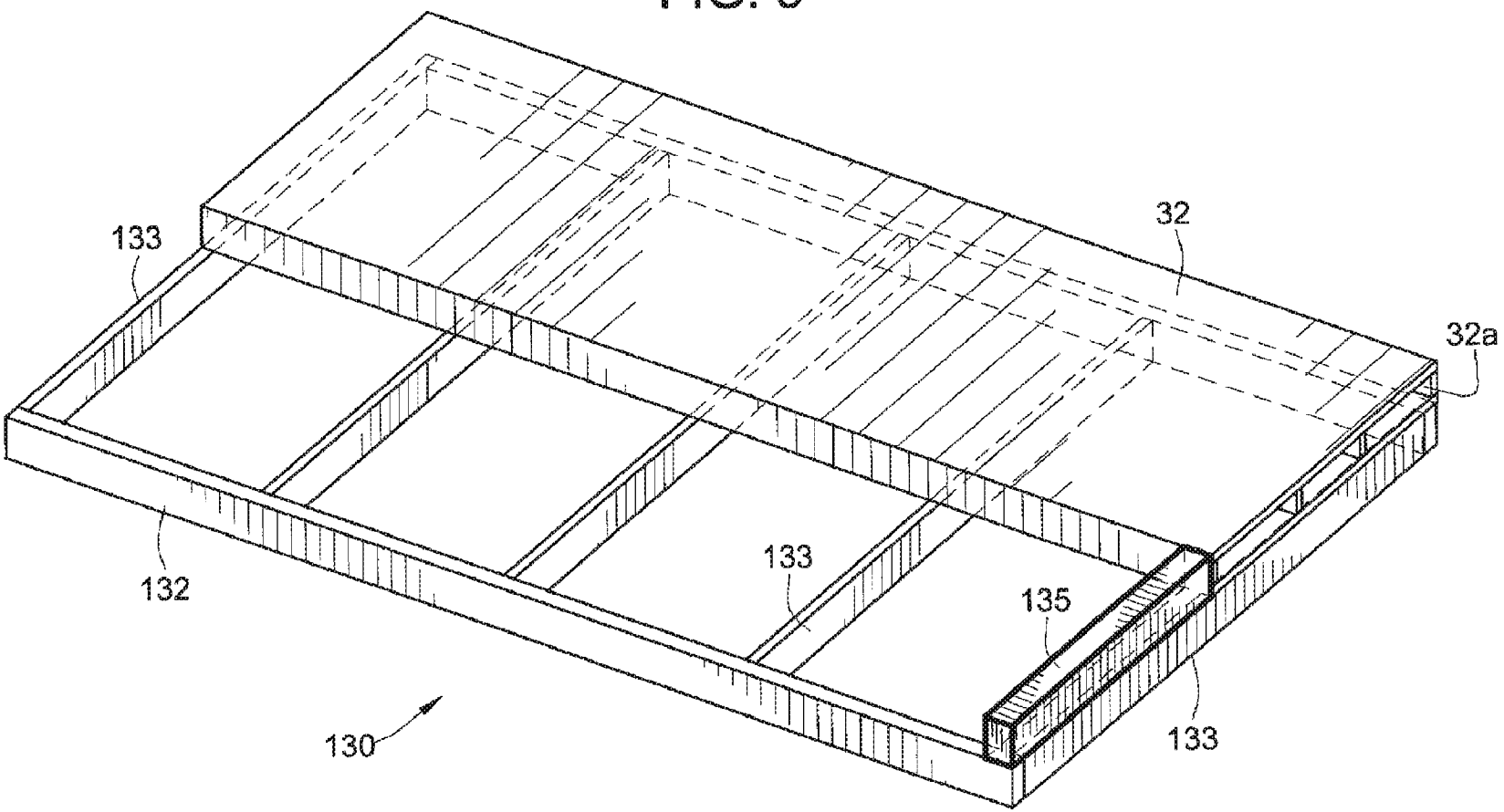
FIG. 8 is a perspective view of a jig assembly for supporting a vessel to be filled, constructed according to teachings of the invention.

In order to facilitate loading of vessels 32 of various sizes and configurations onto the carrier assembly, the vessel 32 can be placed in a jig assembly 130. As depicted in FIG. 8, a suitable jig assembly 130 comprises at least two vertical members 132 and a plurality of crossmembers 133. When placed on the jig assembly 130, the vessel 32 rests on top of the vertical members 132 and the crossmembers 133. In order to prevent movement of the vessel 32 relative to the jig assembly 130, the vessel 32 can be temporarily attached to the jig assembly using clamps or any other suitable temporary fastener. In order to allow an apparatus comprising a fixed-width container to fill structures of varying sizes (e.g., a vessel having a width less than the width of the container opening), the jig assembly can further comprise a spacer 135. The spacer can be temporarily attached to the jig assembly 130 (e.g., temporarily attached to a crossmember at the end of the jig assembly) using a clamp or any other suitable apparatus. Typically, the size of the spacer (e.g., the length of the spacer) is sufficient to span any portion of the width of the jig assembly 130 not covered by the vessel 32. The thickness of the spacer 135 typically is substantially the same as the thickness of the vessel 32. The jig assembly can further comprise a plurality of hooks (e.g., about 2, or about 4) fixedly attached to the vertical members and/or crossmembers located at the distal end(s) of the vertical members. Such hooks can be used to attach one or more lines to the jig assembly to assist in the loading and unloading of the jig assembly from the carrier assembly.

In order to facilitate viewing of the fill process by a person operating an apparatus according to the teachings of the invention, the apparatus can further comprise a lighting assembly. As depicted in FIG. 1 and FIG. 4, the lighting assembly 138 is positioned beneath the carrier assembly 42 and is adapted to light the vessel 32 when the vessel 32 is positioned on the carrier assembly 42.

The apparatus of the invention can be used to fill the internal volume of any suitable vessel with any suitable particulate matter. Some examples of such suitable vessels are disclosed in greater detail in a simultaneously filed U.S. Non-Provisional application Ser. No. 10/679,121, published as U.S. Patent Application Publication No. 2005/0074566, and entitled "Insulated Panel and Glazing System Comprising the Same" assigned to the same assignee, which application is incorporated herein by reference for all that it discloses. In particular, the vessel can comprise a panel having an outer wall defining an internal volume (e.g., internal channel). The outer wall of such a panel comprises an inner surface, and the inner surface can further comprise at least one inner wall protruding from the inner surface. Preferably, the vessel comprises a first sheet, a second sheet, and two or more supporting members disposed between the sheets, the supporting members defining one or more channels disposed between the first and second sheets, and the channels have an internal volume. The sheets and supporting members of such a vessel can be formed of any suitable material. Preferably, the vessel is a thermoplastic panel, and at least the first and second sheets comprise a thermoplastic resin. The first sheet, second sheet, and supporting members can be unitarily formed of a thermoplastic resin. Suitable thermoplastic resins include, but are not limited to, polycarbonate, polyethylene, poly(methyl methacrylate), poly(vinyl chloride), and mixtures thereof. It will be appreciated, however, that the method and apparatus describe herein may be utilized to fill substantially any vessel.

Figure 9:
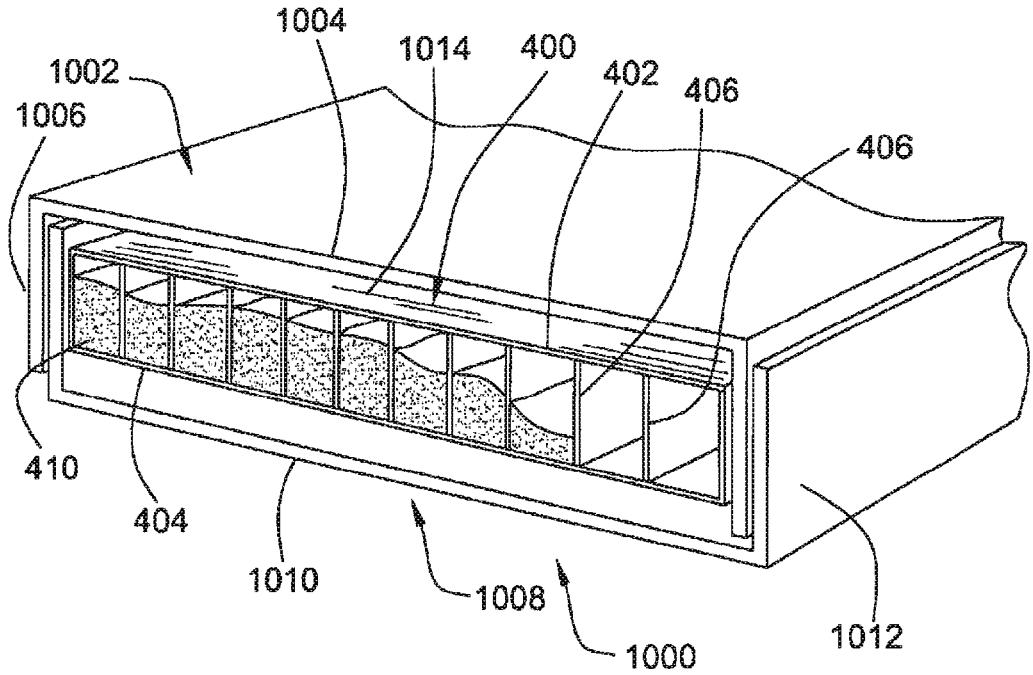
FIG. 9 is a perspective sectional view of an insulated glazing system according to teachings of the invention comprising a first element, a second element, and an insulating panel disposed within the cavity formed by the elements, the insulating panel comprising a first thermoplastic sheet, a second thermoplastic sheet, and at least two supporting members disposed between the first and second thermoplastic sheets to define at least one channel disposed between the first and second thermoplastic sheets.

An example of a glazing system is illustrated in FIG 9. Shown in FIG. 9 is panel 400, comprising a first thermoplastic sheet 402, a second thermoplastic sheet 404, and two or more supporting members 406 disposed between the first and second thermoplastic sheets 402, 404. The first thermoplastic sheet 402 preferably is substantially parallel to the second thermoplastic sheet 404. The supporting members 406 define at least one channel 408 disposed between the first and second thermoplastic sheets 402, 404. Insulating panel 400 may be included in the glazing system 1000.

Figure 10:
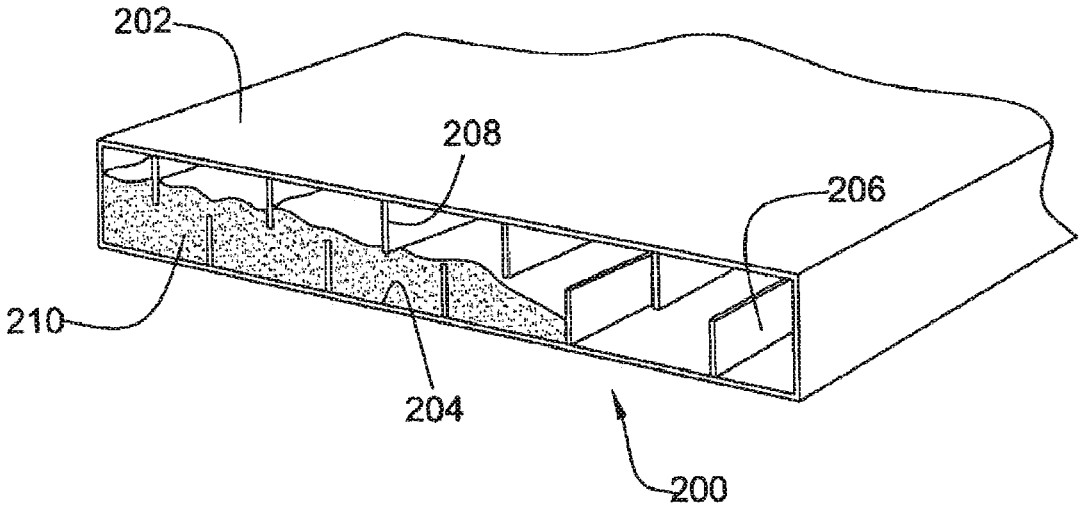
FIG. 10 is a perspective sectional view of an insulating panel comprising an outer wall defining an internal channel and a plurality of inner walls protruding into the inner channel from opposing portions of the inner surface of the outer wall.

Another embodiment of a panel that can be incorporated in a glazing system includes at least one inner wall protruding from an inner surface of the panel. Shown in FIG. 10, for instance, is a panel having inner walls 208 protruding from inner surface 204.

The method of the invention can be used to fill the internal volume of a vessel with any suitable particulate matter. Typically, the method is used to fill the vessel with electrostatically chargeable particles. One example of such particulate matter comprises hydrophobic aerogel particles. The hydrophobic aerogel particles can be any suitable hydrophobic aerogel particles. Suitable hydrophobic aerogel particles include organic aerogel particles, inorganic aerogel particles (e.g., metal oxide aerogel particles), or a mixture thereof. When the hydrophobic aerogel particles comprise organic aerogel particles, the organic aerogel particles preferably are selected from the group consisting of resorcinol-formaldehyde aerogel particles, melamine-formaldehyde aerogel particles, and combinations thereof. When the hydrophobic aerogel particles comprise inorganic aerogel particles, the inorganic aerogel particles preferably are metal oxide aerogel particles selected from the group consisting of silica aerogel particles, titania aerogel particles, alumina aerogel particles, and combinations thereof. Most preferably, the hydrophobic aerogel particles are silica aerogel particles.

The method of the invention can provide a vessel that is filled with the particulate matter at any suitable density. When the vessel is subjected to at least one tamping motion, the density of the particulate matter contained within the internal volume of the vessel generally is greater than the pour density of the particulate matter. Preferably, the density of the particulate matter contained within the internal volume of the vessel is at least about 5 percent, more preferably at least about 10 percent, greater than the pour density of the particulate matter.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method for filling a glazing panel having an internal volume with aerogel particles, the method comprising the steps of:

(a) providing a glazing panel having a length, width, and an internal volume, (b) providing a supply of aerogel particles, (c) subjecting the glazing panel to a vibratory motion, (d) filling at least a portion of the internal volume of the panel with aerogel particles while the glazing panel is being subjected to the vibratory motion, (e) repeating steps (c) and (d) until the internal volume of the glazing panel has been filled with the desired amount of aerogel particles.

2. The method of claim 1, wherein the at least a portion of a static electricity produced prior to or during step (d) is discharged.

3. The method of claim 1, wherein the glazing panel has more than one internal channels.

4. The method of claim 1, wherein the glazing panel is comprised in a glazing system.

5. The method of claim 1, wherein the method further comprises subjecting the glazing panel to at least one tamping motion.

6. The method of claim 1, wherein the aerogel particles are hydrophobic.

7. The method of claim 1, wherein the aerogel particles are metal oxide aerogel particles.

8. The method of claim 7, wherein the metal oxide aerogel particles are selected from the group consisting of silica aerogel particles, titania aerogel particles, alumina aerogel particles, and any combination thereof.

9. The method of claim 1, wherein the aerogel particles are organic aerogel particles.

10. The method of claim 1, wherein the glazing panel includes a first sheet and a second sheet and the first and second sheets are thermoplastic sheets.

11. The method of claim 10, wherein the thermoplastic sheets comprise a thermoplastic resin selected from the group consisting of polycarbonate, polyethylene, poly(methyl methacrylate), poly(vinyl chloride), and mixtures thereof.

12. A method for filling a glazing panel having an internal volume with aerogel particles, the method comprising the steps of:

(a) providing a glazing panel having a length, width, and an internal volume, (b) providing a supply of aerogel particles, (c) subjecting the glazing panel to a vibratory motion, (d) filling at least a portion of the internal volume of the panel with aerogel particles while the glazing panel is being subjected to the vibratory motion, (e) repeating steps (c) and (d) until the internal volume of the glazing panel has been filled with the desired amount of aerogel particles, wherein the glazing panel includes a first sheet, a second sheet, and two or more supporting members disposed between the sheets, the supporting members defining one or more channels disposed between the first and second sheets and the channels having an internal volume.

13. A method for filling a glazing panel having an internal volume with aerogel particles, the method comprising the steps of:

(a) providing a glazing panel having a length, width, and an outer wall defining an internal volume, (b) providing a supply of aerogel particles, (c) subjecting the glazing panel to a vibratory motion, (d) filling at least a portion of the internal volume of the panel with aerogel particles while the glazing panel is being subjected to the vibratory motion, (e) repeating steps (c) and (d) until the internal volume of the glazing panel has been filled with the desired amount of aerogel particles, wherein the glazing panel includes a at least one inner wall protruding from an inner surface of the outer wall.

* * * * *